US008387642B2

(12) United States Patent
Ball

(10) Patent No.: US 8,387,642 B2
(45) Date of Patent: Mar. 5, 2013

(54) DOOR FOR FABRIC ENCLOSURE

(75) Inventor: Allan Ball, Winnipeg (CA)

(73) Assignee: 6262237 Manitoba Ltd., Winnipeg, MB (CA)

( * ) Notice: Subject to any disclaimer, the term of this patent is extended or adjusted under 35 U.S.C. 154(b) by 0 days.

(21) Appl. No.: 13/016,562

(22) Filed: Jan. 28, 2011

(65) Prior Publication Data

US 2011/0209736 A1 Sep. 1, 2011

Related U.S. Application Data

(63) Continuation-in-part of application No. 11/225,881, filed on Sep. 14, 2005, now Pat. No. 7,882,850.

(60) Provisional application No. 60/610,178, filed on Sep. 16, 2004.

(51) Int. Cl.
*E04H 15/58* (2006.01)

(52) U.S. Cl. ..... 135/117

(58) Field of Classification Search ..... 135/117, 135/136, 87, 115, 116; 49/34; 160/354
See application file for complete search history.

(56) References Cited

U.S. PATENT DOCUMENTS

| | | | | | |
|---|---|---|---|---|---|
| 3,204,649 | A * | 9/1965 | Johnson | 52/2.14 |
| 3,387,412 | A * | 6/1968 | Kwake | 52/2.14 |
| 3,744,501 | A * | 7/1973 | Kozarsky | 52/2.12 |
| 4,000,749 | A * | 1/1977 | Busco | 600/21 |
| 4,220,298 | A * | 9/1980 | Willis | 244/129.5 |
| 4,858,635 | A * | 8/1989 | Eppenbach | 135/125 |
| 6,360,761 | B1 * | 3/2002 | Zheng | 135/126 |
| 6,390,112 | B1 * | 5/2002 | Christiansen | 135/143 |
| 2002/0157697 | A1 * | 10/2002 | Choi | 135/119 |
| 2008/0210283 | A1 * | 9/2008 | Hinz et al. | 135/121 |

* cited by examiner

*Primary Examiner* — Noah Chandler Hawk
(74) *Attorney, Agent, or Firm* — Adrian D. Battison; Ade & Company Inc

(57) ABSTRACT

In a fabric enclosure such as a tent wall there is provided an opening in the fabric panel with a fabric closure panel for closing the opening having a hinge line along one side connecting the closure panel to the wall panel. The opening and the closure panel each define an edge thereof opposite to the hinge line which is curved from an end at the hinge line around to an opposite end separated from the hinge line by a non-flexible rod with the edge of the closure panel overlapping the edge of the opening for closure thereon and a flexible bowing strip attached to the edge of the closure panel which is forced into a bowed shape to apply tension to the closure panel tending to maintain the panel flat.

18 Claims, 11 Drawing Sheets

DOOR FOR FABRIC ENCLOSURE

This application claims the benefit under 35USC 119 of the filing date of provisional application 60/610,178 filed Sep. 16, 2004.

This application is a continuation in part of patent application Ser. No. 11/225,881, filed Sep. 14, 2005 and now issued to U.S. Pat. No. 7,882,850.

The invention provides a new door and frame assembly to replace the common zipper door on camping tents, outdoor dining tents and screen rooms.

BACKGROUND OF THE INVENTION

The common camping, dining or screen tent typically utilizes a zippered flap of material or screen to act as the doorway into and out of the tent. To enter or exit the tent it is necessary to bend down, open the zipper, bend over and pass through the doorway, and then turn around and close the zipper. Because of the loose material, it often requires two hands, and is often difficult if a person is carrying something.

Considered broadly, tents disclosed herein are of a portable type, comprised of fabric roofs and walls and often including waterproof fabric floors. The tents are usually supported by rigid metal, fiberglass, or composite poles and frame. The entry method into and out of the tent is by means of a fabric zippered door.

SUMMARY OF THE INVENTION

It is one object of the invention to provide an improved fabric enclosure with an improved door construction providing an opening with a closure panel in one wall.

According to one aspect of the invention there is provided a fabric structure comprising:

a fabric wall panel of the fabric structure defining a plane of the panel and defining side edges of the wall panel and a bottom of the wall panel for resting along a ground surface;

an opening in the fabric wall panel;

a fabric closure panel for closing the opening having a hinge line along one side connecting the closure panel to the wall panel;

wherein the fabric wall panel at the opening and the fabric closure panel each define an edge thereof opposite to the hinge line with the edge of the fabric closure panel overlapping the edge of the fabric wall panel at the opening for closure thereon;

wherein the edge is curved;

a flexible bowing strip attached to the edge of the fabric closure panel opposite to the hinge line, which bowing strip is forced into a bowed shape from an initial different shape such that the flexible bowing strip tends to return to the initial shape generating forces in the bowing strip biasing ends of the bowing strip apart;

and wherein the flexible bowing strip is attached to the edge of the closure panel such that the forces in the bowing strip biasing the ends of the bowing strip apart act to apply tension to the closure panel tending to maintain the panel flat.

According to an important aspect, the curved edge extends from a top end at the hinge line around to an opposite end at position at a floor of the fabric wall panel, which position is spaced from the hinge line.

Preferably there is provided a straight non-flexible, stiff brace attached to the bottom edge of the closure panel from said position to the hinge line.

Preferably there is provided a connecting member attached to the closure panel at the position to receive an end of the brace and an end of the bowing strip.

Preferably the connecting member is a molded piece having a first receptacle for the end of the brace and a second receptacle for the end of the bowing strip.

Preferably the brace is attached to the edge of the closure panel by at least one sleeve on the edge of the closure panel.

Preferably there is provided a fabric door sweep attached to the bottom edge of the closure panel which engages the ground surface in the closed position.

Preferably the fabric wall panel is arranged to have no sill portion thereof extending upwardly from the ground surface at the bottom edge at the opening.

Preferably the fabric wall panel is arranged to lie substantially flat against the ground surface at the bottom edge at the opening.

Preferably the fabric wall panel includes a strap lying substantially flat against the ground surface at the bottom edge at the opening.

Preferably there is also a second flexible bowing strip attached to the edge of the opening opposite to the hinge line, which second bowing strip is forced into a bowed shape from an initial different shape such that the flexible bowing strip tends to return to the initial shape.

Preferably the flexible bowing strip is attached to the edge of the closure panel by a sleeve on the edge of the closure panel.

Preferably each end of the bowing strip is contained in a respective top and bottom retainer pockets attached to the fabric wall panel so as to transfer the tension from the bowing strip into the fabric wall panel.

Preferably the top retainer pocket is mounted on the fabric wall panel for pivotal movement of the retainer pocket relative to the fabric wall panel about the hinge line, where the hinge line lies at an angle to the bowing strip at the end of the bowing strip.

Preferably the bottom retainer pocket is attached to the fabric wall panel and defines a rigid pocket into which an end of the flexible bowing strip is inserted so as to be rigidly connected to the straight non-flexible door brace which is inserted into the other side of the pocket.

Preferably there is provided a fastening system for releasably fastening the overlapping edges together.

Preferably the hinge line lies in a plane of the fabric wall panel and is inclined in that plane in a direction such that, when viewed in a front elevation of the fabric closure panel, the hinge line is inclined to the vertical in a direction such that a top end of the hinge line is located to a side of a bottom end of the hinge line toward the closure panel.

The arrangement described in more detail hereinafter utilizes a fabric door panel with a rigid frame comprising straight and arched segmented metal, fiberglass, or composite rods. The door frame, as part of the tent wall, also utilizes a segmented metal, fiberglass, or composite rod to provide opening shape. The rods are assembled into one piece and when attached to the tent fabric form a combined straight and bent segment-of-a-circle arch. The rod is attached to the tent fabric by hoops of fabric around the periphery of the door and door opening. Overlapping fabric edges between the door and the frame in the tent wall prevent fly and mosquito egress. The door pivots on a reinforced fabric hinge. The door is opened in a conventional fashion, by pulling on a handle on one side, stepping through the doorway and closing the door behind. Velcro or magnetic closures keep the door closed. On most sloped wall tents, the door is also self-closing.

One variation of this invention would be the use of compressed gas tubes to provide the arched shape to the fabric door panel and door frame.

There is referenced a number of times herein the use of segmented rods for use as the bowing strip. Another variation would be the use of a continuous rod that rolled up for travel (somewhat like a tape measure). Another variation of this invention would be the use of non-segmented metal, fiberglass or composite flat bar to provide the arched shape to the fabric door panel and door frame.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION OF THE INVENTION

The embodiment comprises a number of components attached to the fabric tent wall 1, which include:

1—fabric tent wall,
2—fabric door,
3—stiffening fabric at hinge line;
4—flexible bowing strip-opening frame;
5—tension hoop—opening frame;
6—stiffened edge—opening frame;
7—bowing strip retainer—opening frame (one at the top of the door and one at the bottom);
8—bowing strip hook and loop restraint—opening frame (one at the top of the door and one at the bottom);
9—flexible bowing strip—door frame;
10—tension hoop—door frame
11—stiffened edge—door frame;
12—bowing strip retainer—door frame top;
13—bowing strip retainer—door frame bottom;
14—hook and loop/magnetic closure;
15—ground spike loop—side wall;
16—handle;
17—ground spike loop—corner;
18—conventional tent;
19—fabric hinge centerline;
20—reinforcement pad.

Figure 1:
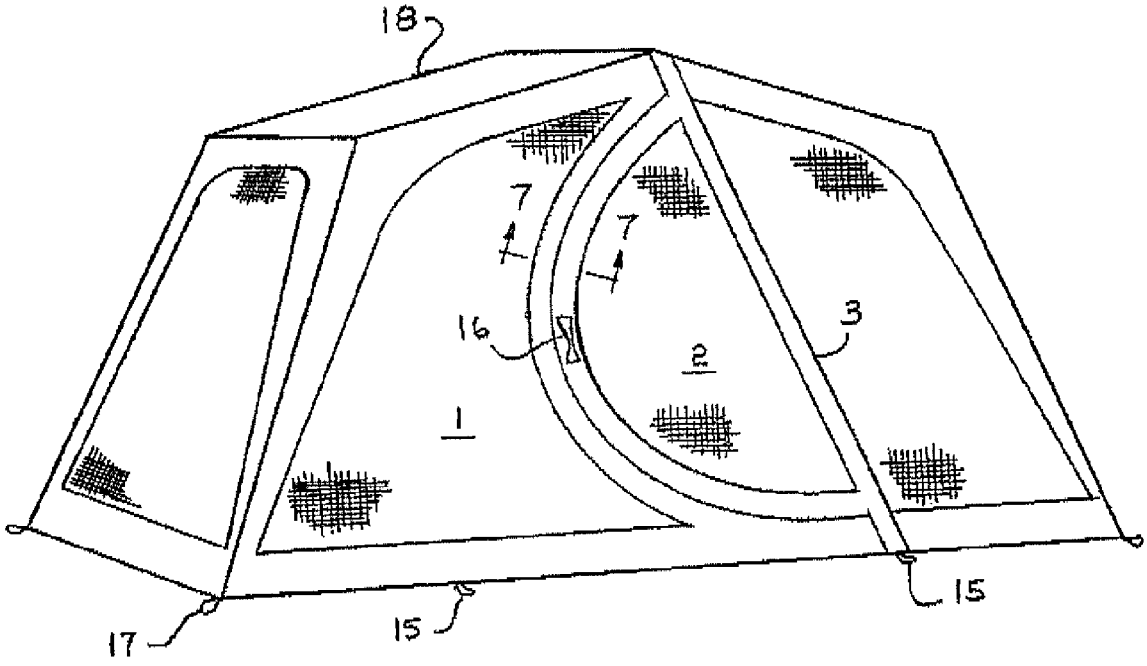
FIG. 1 is an isometric view of a conventional pole supported tent showing the tent door and frame on one side of the tent and including the closure according to the present invention.

The invention provides a door assembly and an opening assembly. A general arrangement of the two assemblies is shown in FIG. 1.

The door assembly provides a straight segmented flexible bowing strip door frame 9 (constructed of metal, fiberglass or composites), which is inserted into a semi-circle-shaped door frame tension hoop 10 (constructed of fabric) attached to the fabric door 2. The ends of the flexible bowing strip door frame 9 are positioned and restrained by the bowing strip retainers 12 and 13 (constructed of reinforced plastic or fabric) at the top and bottom of the door. Insertion of the bowing strip 9 into the semi-circle shaped tension hoop 10 and bowing strip restraint by the bowing strip retainers 12 and 13 causes the door fabric to be stretched tight and maintain the shape bowing strip 9 into the semi-circle-shaped door frame tension hoop 10. A fabric handle 16 provides a convenient grasp for opening the door.

The opening assembly consists of a straight segmented flexible bowing strip opening frame 4 (constructed of metal, fiberglass or composites), which is inserted into a semi-circle-shaped opening frame tension hoop 5 (constructed of fabric) attached to the tent wall. The ends of the flexible bowing strip opening frame 4 are positioned and restrained by the bowing strip retainers 7 (constructed of reinforced plastic or fabric) and bowing strip hook and loop restraints 8 at the top and bottom of the door opening. Insertion of the straight bowing strip 4 into the semi-circle-shaped opening frame tension hoop 5 and bowing strip restraint by the bowing strip retainers 7 and bowing strip hook and loop restraints 8 causes the tent wall to be tight and the door opening to match the shape and size of the door. A reinforcement pad 20 provides additional strength to the fabric of the assembly.

The door assembly has a stiffened edge 11 which is a band of stiffer material fastened to the fabric extending around the semi-circle defined by the inside of the door frame tension hoop 10 which mates with a stiffened edge 6 on the outside of the opening frame tension hoop 5. The purpose of the stiffened edge is to restrict mosquito and fly egress into the tent. At intervals along the stiffened edge, hook and loop/magnetic closures 14 provide attachment of the door assembly to the opening assembly in order to resist the wind from opening the door assembly. A stiffening fabric at the hinge line 3 allows the door to rotate about the plane of the tent wall. Side wall ground spike loop 15 allows attachments of the stiffening fabric to the ground to maintain the position of the door frame tension hoop 10 relative to the opening frame hoop 5.

The embodiment herein has the following features:

In a camping, dining or screen tent, the use of a rigidly framed door assembly and rigidly framed opening assembly, the combination of which provides convenient hinged door access to and from the tent.

The rigidly framed door assembly comprising of a straight segmented flexible bowing strip door frame 9, held in tension in a semi-circle shape by bowing strip retainers 12 and 13.

The rigidly framed opening assembly comprising of a straight segmented flexible bowing strip opening frame 4, held in tension in a semi-circle shape by bowing strip retainers 7 and bowing strip hook and loop restraints 8.

The door frame tension hoop 10 and opening frame tension hoop 5 which give shape to the door and tent wall fabric.

The stiffened edges 6 and 11 to resist mosquitoes and flies from entering the tent.

The hook and loop/magnetic closures 14 to prevent the unintended opening of the door assembly.

The arrangement of FIGS. 8 to 12 is similar to that described above so that only the important differences will be described as follows.

Figure 2:
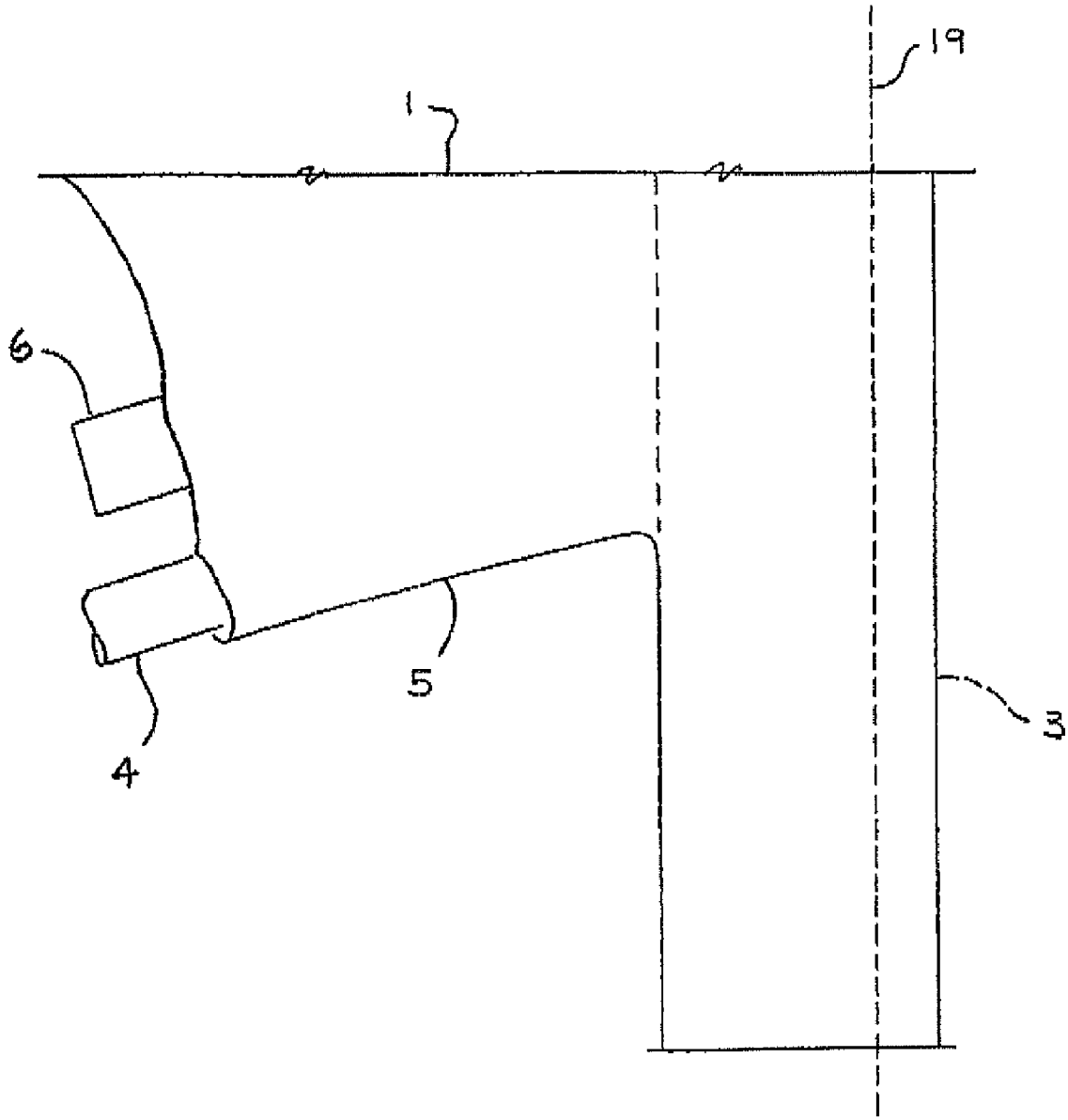
FIG. 2 is an elevational view of the embodiment of FIG. 1 showing the opening tension hoop with the door tension hoop not shown for clarity.

The door assembly provides a straight segmented flexible bowing strip door frame 30 constructed of metal, fiberglass or composites similar to that previously described. This is inserted into an arc-shaped door frame tension hoop 31 constructed of fabric attached to the fabric door 2. The top end of the flexible bowing strip door frame 30 is positioned and restrained by the bowing strip retainer at the top of the door as shown in the previous embodiment in FIG. 2.

Figure 10:
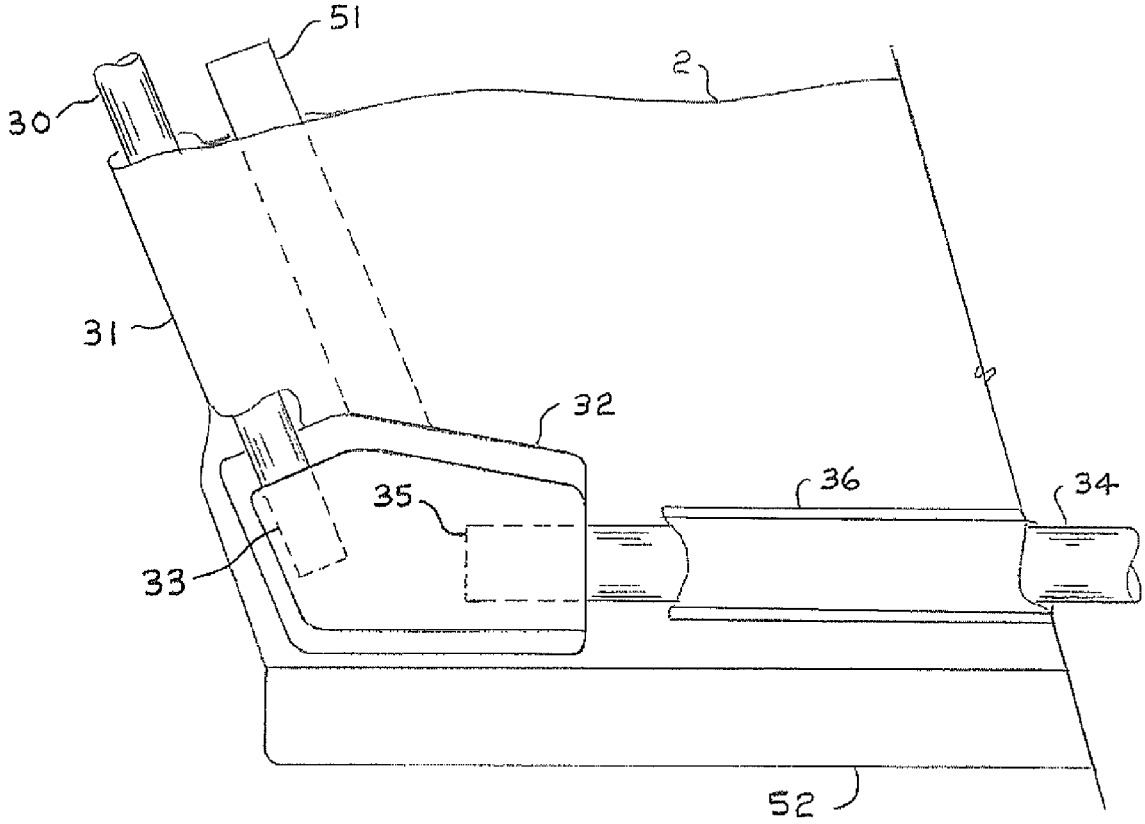
FIG. 10 is an elevational view of the door tension hoop, door bottom brace and corner bowing strip retainer.

The bottom of the bowing strip 30 as shown in FIG. 10 is inserted into a cylindrical receptacle 33 in a bottom stiff retainer 32 constructed of reinforced plastic or metal at the bottom of the door. The door assembly also provides a straight segmented non-flexible or stiff door bottom brace 34, constructed of tubular metal, fiberglass or composites so as to be resistant to flexing, which is received in a receptacle 35 in the retainer 32. The retainer 32 is attached to the door 2 at the bottom corner by stitching or adhesive so as to provide a holder for the bowing strip and the brace. The retainer 32 is relatively stiff so as to prevent twisting at the bottom corner and to hold the brace and bowing strip connected at a fixed angle at the bottom corner allowing them to move together as the door is opened.

The brace 34 is inserted into a straight door frame tension hoop or sleeve 36 constructed of fabric and attached to the fabric door 2 along the bottom edge of the door. At the other end of the brace 34, the brace is received in a receptacle 37 of a retainer 38. The retainer 38 is stitched to the fabric of the tent at the hinge line so as to allow the end of the brace to pivot about the hinge line 19.

The ends of the door bottom brace 34 are therefore positioned and restrained by the bowing strip retainers 32 and 38 at the bottom of the door. Insertion of the door bottom brace 34 into the straight tension hoop 36 causes the door fabric to stay flat upon the ground surface when in the closed position.

Insertion of the bowing strip 30 into the arc-shaped tension hoop 31 and bowing strip restraint by the bowing strip retainers 32 and 5 causes the door fabric to be stretched tight and maintain the shape of the door panel. A fabric handle 16 shown in FIG. 8 provides a convenient grasp for opening the door.

In this way the curved edge defined by the bowings strip at the edge of the door extends from a top end at the hinge line around to an opposite end at position defined by the retainer 32 at the floor of the fabric wall panel where the position defined by the retainer is spaced from the hinge line by the length of the brace.

The bowing strip is curved sufficiently that it meets the retainer 32 at an angel to the brace which is greater than 90 degrees. This provides a sufficient curvature on the bowing strip to hold the door tensioned and its fabric flat and to provide tension on the fabric attached to the brace. Also the retainer 32 is sufficiently rigid that it maintains the spatial relationship between the brace and the bowing strip, both in angle rotation and planar position. It effectively couples the brace to the bowing strip, so that the two in combination act much like the original sprung hoop. The brace is held in place in the retainers attached to the door panel fabric by the fact that its length is slightly greater than the distance between the retainers.

Figure 3:
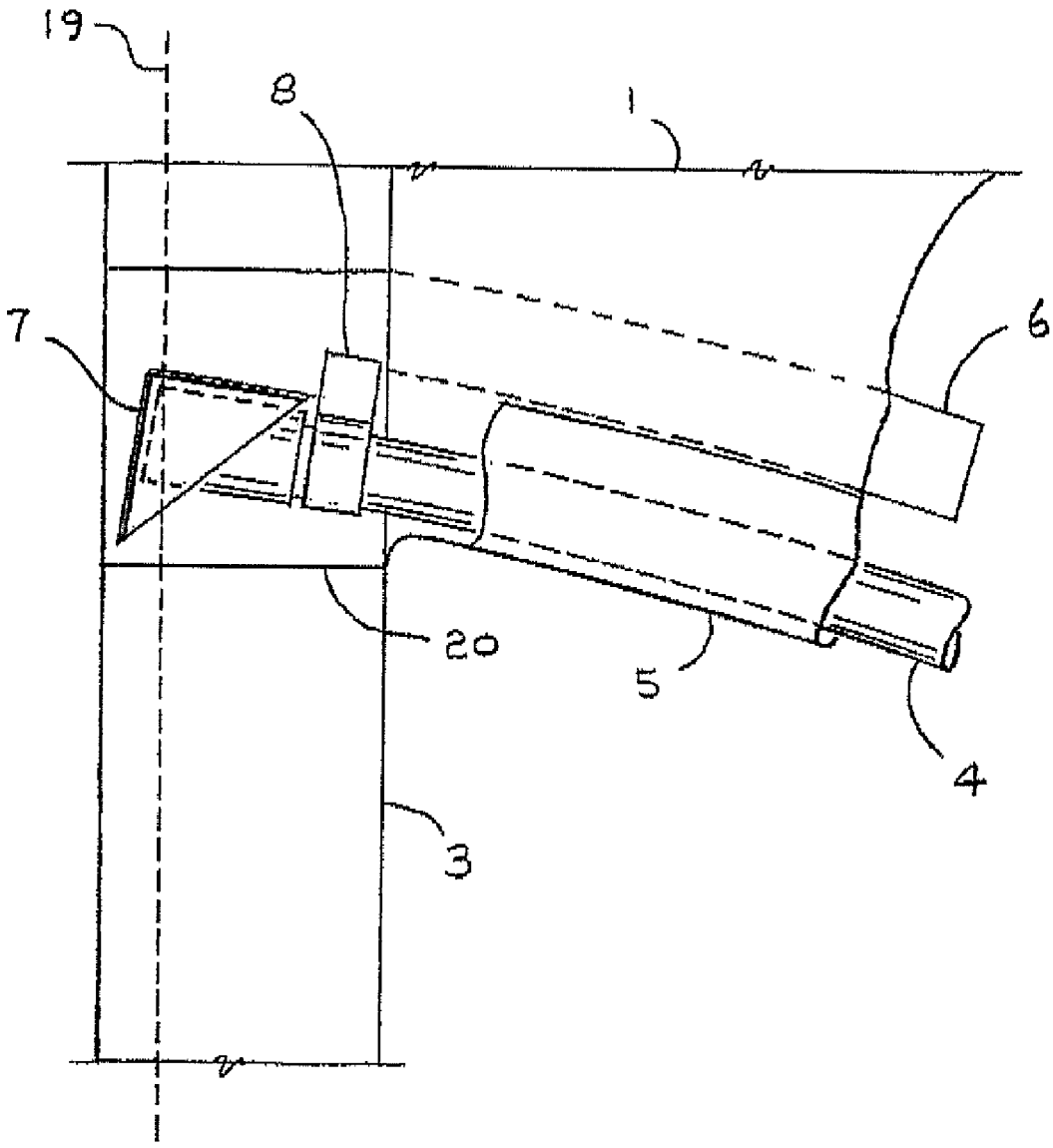
FIG. 3 is an elevational view of the embodiment of FIG. 1 showing the opening tension hoop and top bowing strip retainer, viewed from inside the tent looking out.
Figure 4:
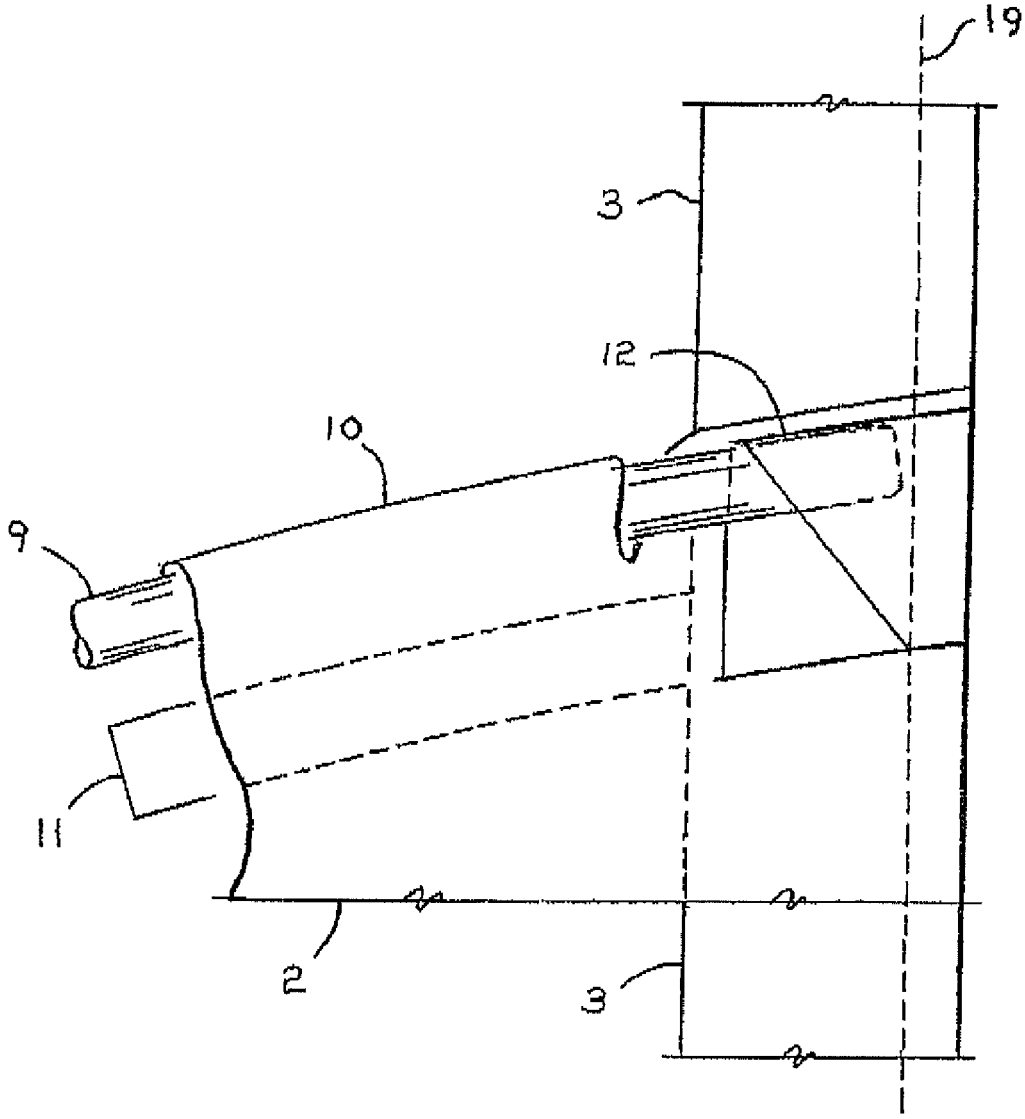
FIG. 4 is an elevational view of the embodiment of FIG. 1 showing the door tension hoop and top bowing strip retainer.
Figure 5:
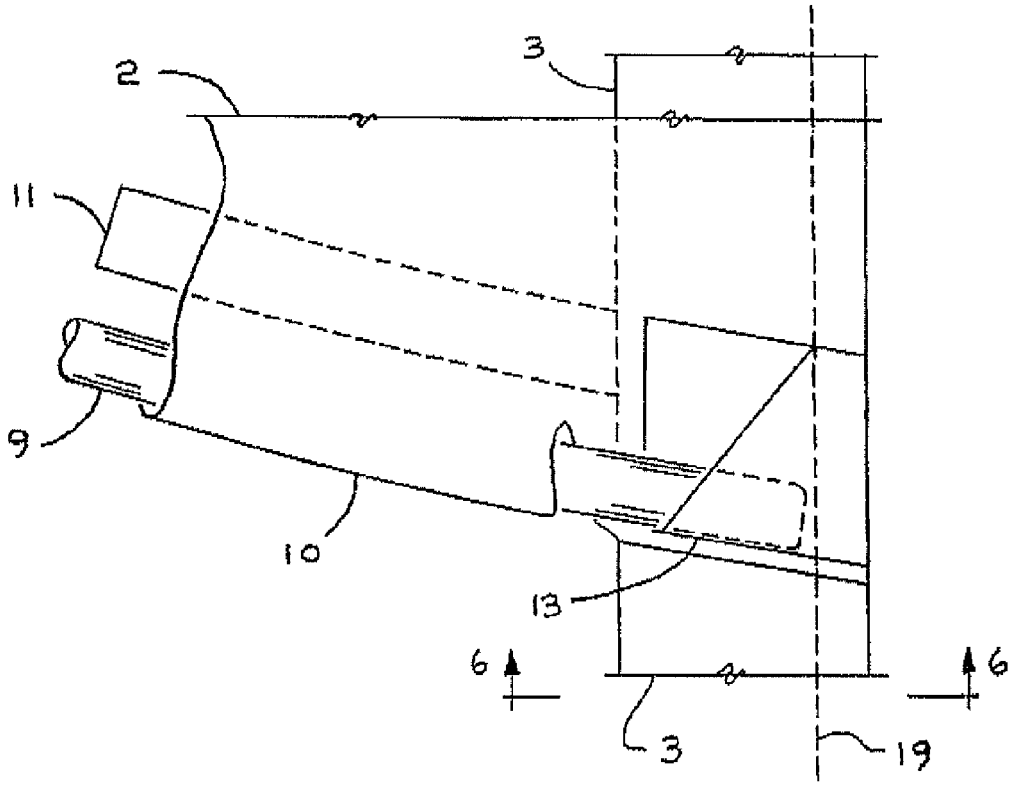
FIG. 5 is an elevational view of the embodiment of FIG. 1 showing the door tension hoop and bottom bowing strip retainer.
Figure 6:
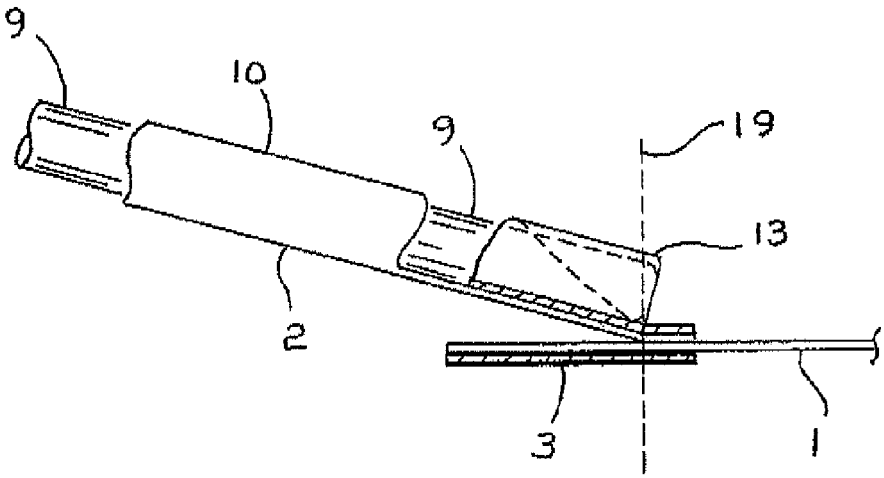
FIG. 6 is a section view of the embodiment of FIG. 1 showing the door tension hoop and bottom bowing strip retainer along the lines 6-6 of FIG. 5.
Figure 8:
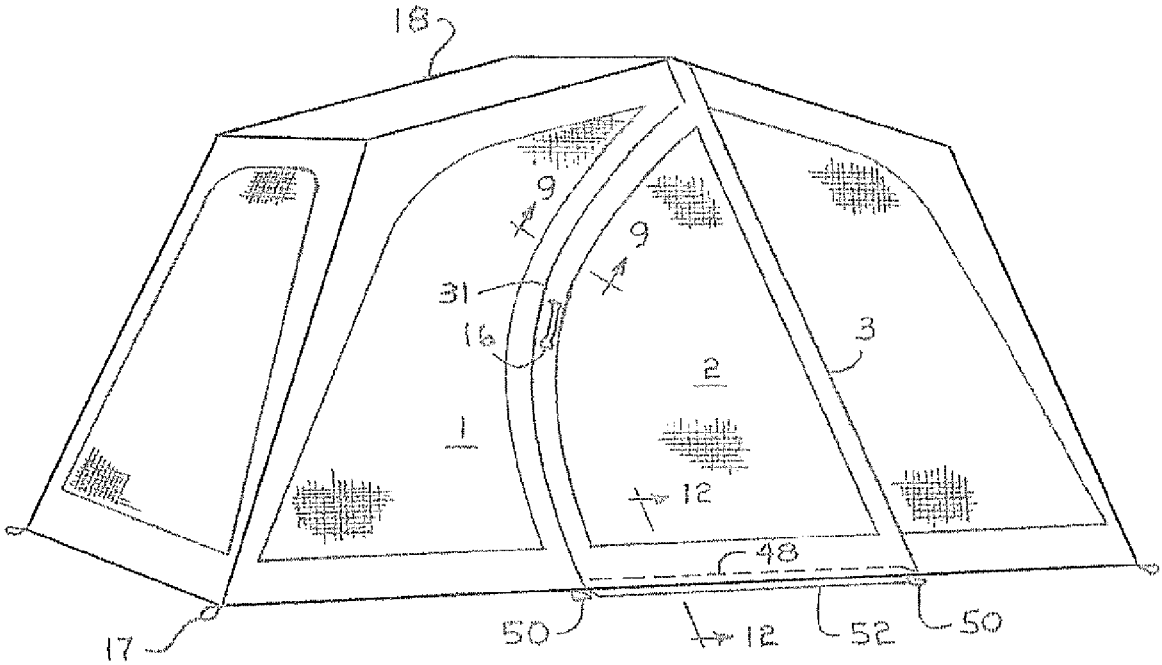
FIG. 8 is an isometric view of a tent showing a second embodiment of the closure.
Figure 9:
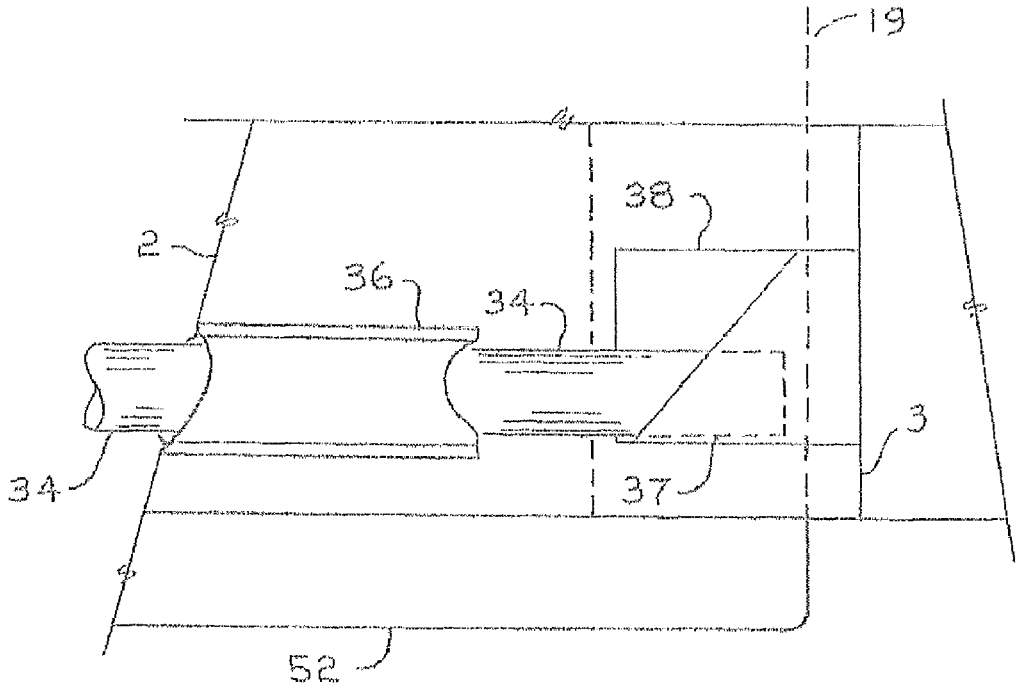
FIG. 9 is an elevational view of the door bottom brace and door bottom brace retainer.
Figure 11:
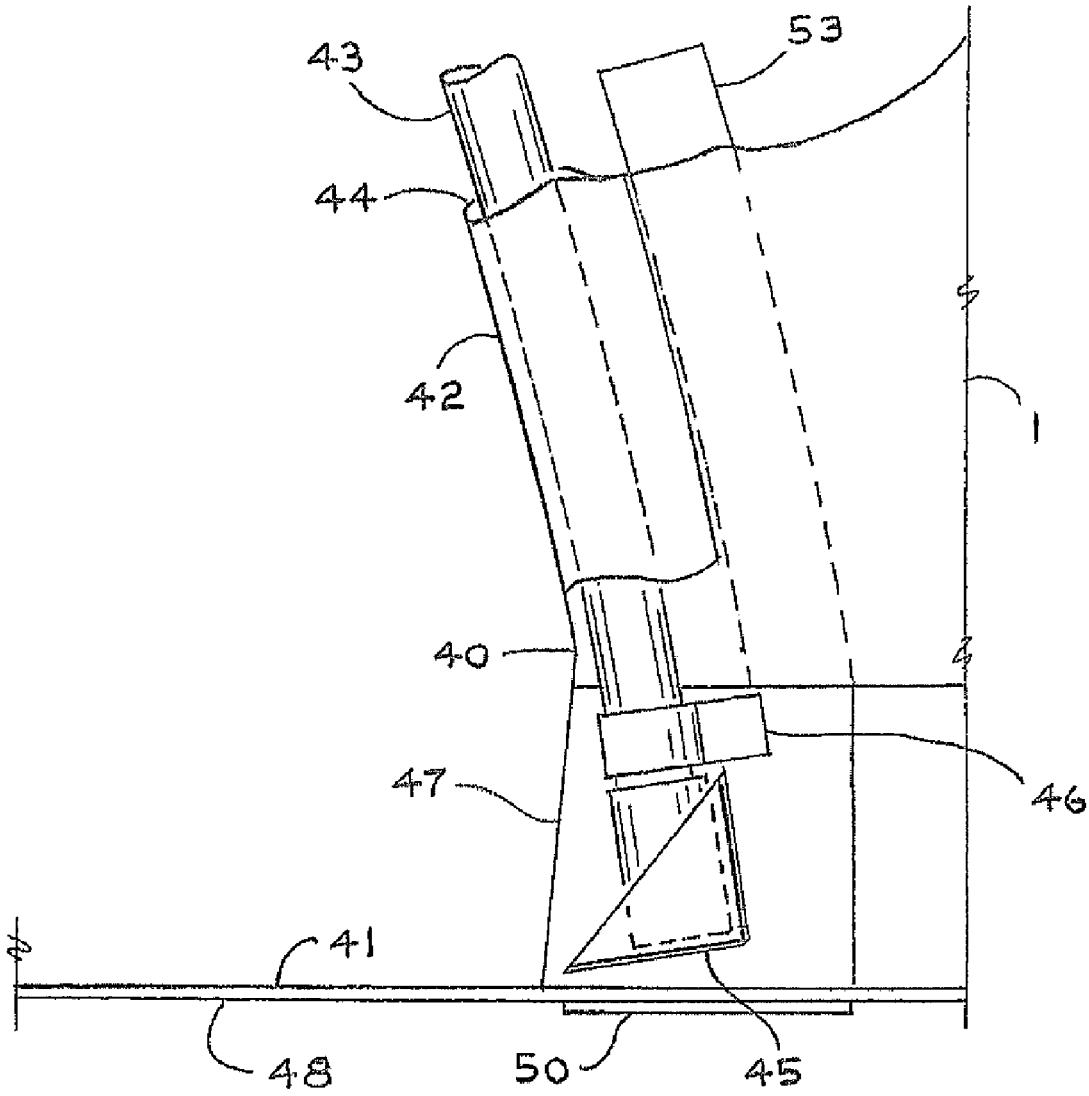
FIG. 11 is an elevational view of the opening in the tent showing the tension hoop and bottom bowing strip retainer, viewed from inside the tent looking out.
Figure 12:
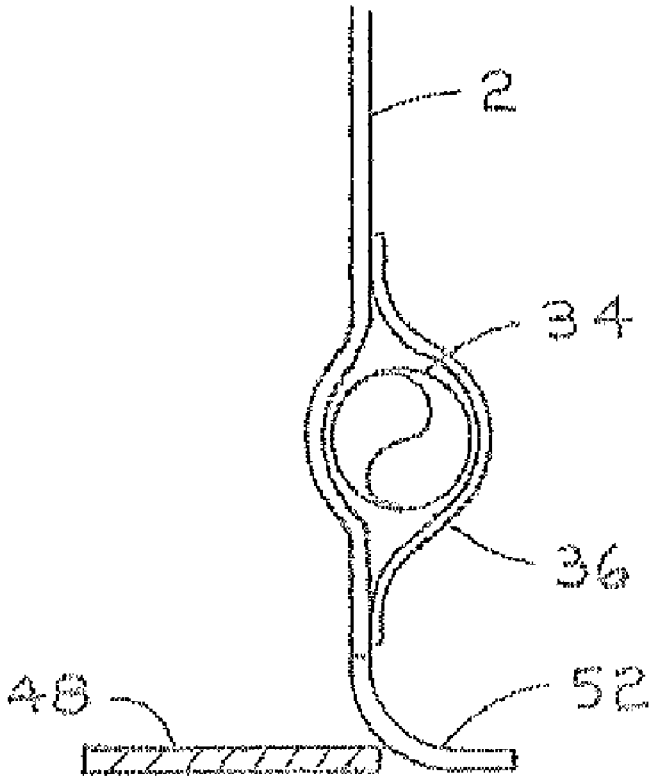
FIG. 12 is a cross-section along the lines 12-12 of FIG. 8.

The opening in the tent 1 shown in FIGS. 8 and 11 is defined by an edge 40 of the fabric tent 2 which is shaped to match the door with a bottom edge 41 matching the length of the brace 34 and an arched top portion 42 extending from the bottom 41 upwardly and around to the hinge line 19 shown in FIG. 3 at the top. A second bowing strip 43 similar in construction to the first is inserted into an arc-shaped fabric hoop 44 at the edge 42. The ends of the second flexible bowing strip 43 are positioned and restrained by the bowing strip retainers 45 at the bottom and 7 shown in FIG. 3 at the top.

The bowing strip 43 is also held in place by a hook and loop restraint 46 at the bottom and by a similar element 8 at the top. These are located adjacent the retainers and act to hold the bowing strip in place when inserted in the retainers. Other arrangements for holding the bowing strip in place can be provided. Bending of the straight bowing strip 43 into the arc-shaped opening frame tension hoop 44 and bowing strip restraint by the bowing strip retainers 45 and bowing strip hook and loop restraints 46 causes the tent wall to be tight and the door opening to match the shape and size of the door.

A reinforcement pad 47 at the bottom edge of the door opening on the side away from the hinge line 19 provides additional strength to the fabric of the assembly and carries the forces from the retainer 45. A door sill strap 48 lays flat on the ground and connects the left side fabric tent wall 1 to the right side fabric tent wall 1 and provides integrity in the opening size and holds the tent wall 1 in a generally planar orientation. Thus the opening assembly and door assembly are held coplanar by ensuring alignment of and maintaining spacing between the bottom left and bottom right sides of the door opening. The ends of the strap 48 are held in place by ground spike loops 50.

Figure 7:
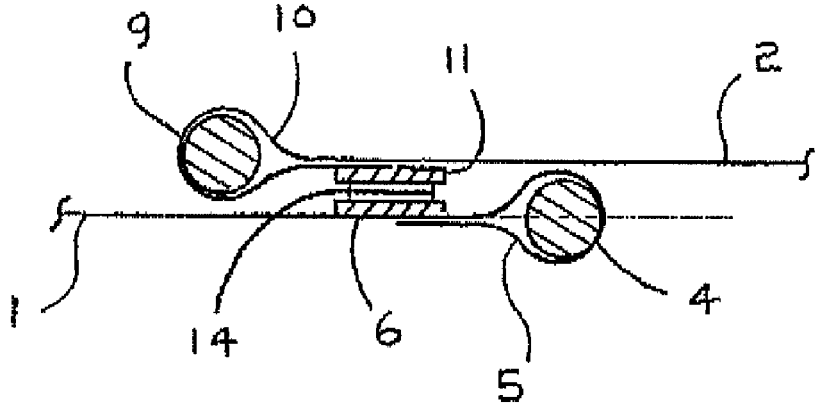
FIG. 7 is a section through the opening tension hoop and door tension hoop along the lines 7-7 of FIG. 1 and showing the general relationship between the two when the door is closed.

The door assembly has a stiffened edge 51 which is a band of stiffer material fastened to the fabric extending around the arc defined by the inside of the door frame tension hoop 31 which mates with a stiffened edge 53 on the outside of the opening frame tension hoop 44. The purpose of the stiffened edge is to restrict mosquito and fly egress into the tent. At intervals along the stiffened edge, closures 14 shown on FIG. 7 provide attachment of the door assembly to the opening assembly in order to resist the wind from opening the door assembly. These can be of the hook and loop or magnetic type. A door sweep 52 constructed of reinforced fabric rests on the ground at the bottom strap 48 and helps to restrict mosquito and fly egress into the tent. A stiffening fabric at the hinge line 19 allows the door to rotate about the plane of the tent wall. The side wall ground spike loop 50 allows attachment of the stiffening fabric to the ground to maintain the position of the door frame tension hoop 31 relative to the opening frame hoop 44.

The embodiment herein has the following features:

In a camping, dining or screen tent, the use of a rigidly framed door assembly and rigidly framed opening assembly, the combination of which provides convenient hinged door access to and from the tent.

The rigidly framed door assembly comprises a flexible bowing strip door frame, held in tension in an arc shape by bowing strip retainers in combination with a non-flexible door bottom brace, held in place by bowing strip retainer and door bottom brace retainer.

The rigidly framed opening assembly comprises a flexible bowing strip opening frame, held in tension in an arc shape by bowing strip retainers and bowing strip hook and loop restraints.

The door frame tension hoop, opening frame tension hoop, and door sill strap which give shape to the door and tent wall fabric.

The stiffened edges and door sweep to resist mosquitoes and flies from entering the tent.

The hook and loop/magnetic closures to prevent the unintended opening of the door assembly.

The fabric wall panel is arranged to have no sill portion thereof extending upwardly from the ground surface at the bottom edge at the opening.

The fabric wall panel is arranged to lie substantially flat against the ground surface at the bottom edge at the opening.

The fabric wall panel includes a strap lying substantially flat against the ground surface at the bottom edge at the opening.

Since various modifications can be made in my invention as herein above described, and many apparently widely different embodiments of same made within the spirit and scope of the Claims without department from such spirit and scope, it is intended that all matter contained in the accompanying specification shall be interpreted as illustrative only and not in a limiting sense.

The invention claimed is:

1. A fabric structure comprising:

a fabric wall panel of the fabric structure defining a plane of the panel and defining side edges of the wall panel and a bottom of the wall panel for resting along a ground surface;

an opening in the fabric wall panel;

a fabric closure panel for closing the opening having a hinge line along one side connecting the closure panel to the wall panel;

wherein the fabric wall panel at the opening and the fabric closure panel each define an edge thereof opposite to the hinge line with the edge of the fabric closure panel overlapping the edge of the fabric wall panel at the opening for closure thereon;

a flexible bowing strip attached to the edge of the fabric closure panel opposite to the hinge line;

the flexible bowing strip having first and second ends which are separate from one another allowing relative movement of one relative to the other;

the flexible bowing strip being forced into a flexed shape by engagement with the edge of the fabric closure panel from an initial different shape of the bowing strip such that the flexible bowing strip is under tension tending to return the flexible bowing strip to the initial shape;

the tension in the flexible bowing strip acting to generate forces in the flexible bowing strip biasing the first and second separate ends of the flexible bowing strip in a direction apart from one another;

the forces in the bowing strip biasing the first and second separate ends of the bowing strip apart applying tension to the fabric closure panel tending to maintain the fabric closure panel flat.

2. The fabric structure according to claim 1 including a fastening system for releasably fastening the overlapping edges together.

3. The fabric structure according to claim 1 wherein the hinge line lies in a plane of the fabric wall panel and is inclined in that plane in a direction such that, when viewed in a front elevation of the fabric closure panel, the hinge line is inclined to the vertical in a direction such that a top end of the hinge line is located to a side of a bottom end of the hinge line toward the closure panel.

4. A fabric structure comprising:

a fabric wall panel of the fabric structure defining a plane of the panel and defining side edges of the wall panel and a bottom of the wall panel for resting along a ground surface;

an opening in the fabric wall panel;

a fabric closure panel for closing the opening having a hinge line along one side connecting the closure panel to the wall panel;

wherein the fabric wall panel at the opening and the fabric closure panel each define an edge thereof opposite to the hinge line with the edge of the fabric closure panel overlapping the edge of the fabric wall panel at the opening for closure thereon;

a flexible bowing strip attached to the edge of the fabric closure panel opposite to the hinge line;

the flexible bowing strip having first and second ends which are separate from one another allowing relative movement of one relative to the other;

the first end of the flexible bowing strip being located at a first end of the hinge line and the second end of the flexible bowing strip being located at a second end of the hinge line spaced from the first end;

the flexible bowing strip being forced into a flexed shape by engagement with the edge of the fabric closure panel from an initial different shape of the bowing strip such that the flexible bowing strip is under tension tending to return the flexible bowing strip to the initial shape;

the tension in the flexible bowing strip acting to generate forces in the flexible bowing strip biasing the first and second separate ends of the flexible bowing strip in a direction apart from one another;

the forces in the bowing strip biasing the first and second separate ends of the bowing strip apart applying tension to the fabric closure panel tending to maintain the fabric closure panel flat.

5. The fabric structure according to claim 4 including a fastening system for releasably fastening the overlapping edges together.

6. The fabric structure according to claim 5 wherein there is provided a straight non-flexible brace extending from the second end of the hinge line to said position spaced from the second end of the hinge line outwardly from the hinge line.

7. The fabric structure according to claim 6 wherein there is provided a connecting member attached to the closure panel at the position to receive an end of the brace and an end of the bowing strip.

8. The fabric structure according to claim 6 wherein the brace is attached to the edge of the closure panel by at least one sleeve on the edge of the closure panel.

9. The fabric structure according to claim 6 wherein there is provided a fabric door sweep attached to the bottom edge of the closure panel which engages the ground surface in the closed position.

10. The fabric structure according to claim 6 wherein the fabric wall panel is arranged to have no sill portion thereof extending upwardly from the ground surface at the bottom edge at the opening.

11. The fabric structure according to claim 6 wherein the fabric wall panel is arranged to lie substantially flat against the ground surface at the bottom edge at the opening.

12. The fabric structure according to claim 6 wherein the fabric wall panel includes a strap lying substantially flat against the ground surface at the bottom edge at the opening.

13. The fabric structure according to claim 4 wherein each end of the bowing strip is contained in respective top and bottom retainer pockets attached to the fabric wall panel so as to transfer the tension from the bowing strip into the fabric wall panel.

14. The fabric structure according to claim 13 wherein the top retainer pocket is mounted on the fabric wall panel for pivotal movement of the retainer pocket relative to the fabric wall panel about the hinge line, where the hinge line lies at an angle to the bowing strip at the end of the bowing strip.

15. The fabric structure according to claim 4 wherein the hinge line lies in a plane of the fabric wall panel and is inclined in that plane in a direction such that, when viewed in a front elevation of the fabric closure panel, the hinge line is inclined to the vertical in a direction such that a top end of the hinge line is located to a side of a bottom end of the hinge line toward the closure panel.

16. A fabric structure comprising:

a fabric wall panel of the fabric structure defining a plane of the panel and defining side edges of the wall panel and a bottom of the wall panel for resting along a ground surface;

an opening in the fabric wall panel;

a fabric closure panel for closing the opening having a hinge line along one side connecting the closure panel to the wall panel, the hinge line having first and second spaced ends;

wherein the fabric wall panel at the opening and the fabric closure panel each define an edge thereof opposite to the hinge line with the edge of the fabric closure panel overlapping the edge of the fabric wall panel at the opening for closure thereon;

a flexible bowing strip attached to the edge of the fabric closure panel opposite to the hinge line;

the flexible bowing strip having first and second ends which are separate from one another allowing relative movement of one relative to the other;

the first end of the flexible bowing strip being located at the first end of the hinge line and the second end of the flexible bowing strip being located at a position spaced from the second end of the hinge line outwardly from the hinge line;

and a brace extending from the second end of the hinge line to said position spaced from the second end of the hinge line outwardly from the hinge line;

the flexible bowing strip being forced into a flexed shape by engagement with the edge of the fabric closure panel from an initial different shape of the bowing strip such that the flexible bowing strip is under tension tending to return the flexible bowing strip to the initial shape;

the tension in the flexible bowing strip acting to generate forces in the flexible bowing strip biasing the first and second separate ends of the flexible bowing strip in a direction apart from one another;

the forces in the bowing strip biasing the first and second separate ends of the bowing strip apart applying tension to the fabric closure panel;

the bowing strip and the brace being arranged such that the tension in the fabric closure panel acts to maintain the fabric closure panel flat at the bowing strip and at the brace.

17. The fabric structure according to claim 16 including a fastening system for releasably fastening the overlapping edges together.

18. The fabric structure according to claim 16 wherein the hinge line lies in a plane of the fabric wall panel and is inclined in that plane in a direction such that, when viewed in a front elevation of the fabric closure panel, the hinge line is inclined to the vertical in a direction such that a top end of the hinge line is located to a side of a bottom end of the hinge line toward the closure panel.

* * * * *